United States Patent [19]

Graham, Sr.

[11] Patent Number: 5,027,718

[45] Date of Patent: Jul. 2, 1991

[54] SECTIONAL TABLE

[76] Inventor: William D. Graham, Sr., Star Rte. 2, Box 142-T, Liberty, Tex. 77575

[21] Appl. No.: 435,548

[22] Filed: Nov. 13, 1989

[51] Int. Cl.[5] ..... A47B 57/00

[52] U.S. Cl. ..... 108/64; 297/174

[58] Field of Search ..... 108/64; 297/157, 174, 297/122, 135; 312/107, 140.2

[56] References Cited

U.S. PATENT DOCUMENTS

| | | | |
|---|---|---|---|
| D. 180,331 | 5/1957 | Holmdahl et al. | D6/337 |
| D. 196,121 | 8/1963 | Soszynski | D6/337 |
| D. 211,796 | 7/1968 | Conklin | D6/337 |
| D. 266,211 | 9/1982 | Thom et al. | D6/337 |
| D. 283,377 | 4/1986 | Forsyth | D6/337 |
| 2,713,889 | 7/1955 | White | 297/157 |
| 2,717,028 | 9/1955 | Villemure | 297/159 |
| 3,096,866 | 7/1963 | Glass | 297/159 |
| 3,101,061 | 8/1963 | Amend | 297/157 |
| 4,537,443 | 8/1985 | Bray | 297/159 |

FOREIGN PATENT DOCUMENTS

| | | | |
|---|---|---|---|
| 0618804 | 2/1949 | United Kingdom | 108/64 |
| 2175198 | 11/1986 | United Kingdom | 108/64 |

*Primary Examiner*—Kenneth J. Dorner
*Assistant Examiner*—Gerald A. Anderson
*Attorney, Agent, or Firm*—Neal J. Mosely

[57] ABSTRACT

A sectional table for outdoor use comprises a plurality of substantially identical sections which, when assemled, may be formed into a regular polygon, e.g. octagon, etc., having a central opening of the same polygonal shape adapted to surround a columnar object, such as a tree, shaft or post, or which may have one section omitted to leave open a central opening accessible for service to the table. The table is formed of wood boards of the desired size and shape. Each of the sections comprises a table top of regular trapezoidal shape having a major side of the size of one side of the outer regular polygon and a minor side parallel to the major side and two angular sides. The minor side is of the size of one side of the central polygonal opening. A plurality of vertically extending legs depend from and support the table top. Bench seats are supported on the legs spaced horizontally from the table top major side far enough for a person to sit thereon facing the table top. Bolts, screws or other supporting members secure a plurality of the table sections together in side-to-side relation in a selected configuration. The sections may secured together with the minor sides facing inward to form the desired polygon, with one section omitted to leave a service opening, or with the minor and major sides alternation to produce a linear table assembly. Rectangular table sections may be introduced into the structure to elongate or enlarge the central opening.

16 Claims, 2 Drawing Sheets

SECTIONAL TABLE

BACKGROUND OF THE INVENTION

1. Field of the Invention

This invention relates to new and useful improvements in sectional table for outdoor use and more particularly to one comprising a plurality of substantially identical sections which, when assembled, may be formed into a regular polygon, e.g. octagon, etc., having a central opening of the same polygonal shape adapted to surround a columnar object, such as a tree, shaft or post, or which may have one section omitted to leave open a central opening accessible for service to the table.

2. Brief Description of the Prior Art

The prior art discloses a number of examples of outdoor furniture.

Soszynski U.S. Pat. No. Des. 196,121 shows a design for a triangular outdoor table with integral seats.

Conklin U.S. Pat. No. Des. 211,796 shows a design for an octagonal outdoor table with integral seats.

Forsyth U.S. Pat. No. Des. 283,377 shows a design for a knock down outdoor table with integral seats.

Thom et al. U.S. Pat. No. Des. 266,211 shows a design for another octagonal outdoor table with integral seats.

Villemure U.S. Pat. No. 2,717,028 shows a folding picnic table.

Glass U.S. Pat. No. 3,096,877 discloses a folding table which recesses into surrounding seats.

Bray U.S. Pat. No. 4,537,443 discloses a portable, knock down outdoor table.

SUMMARY OF THE INVENTION

One of the objects of this invention is to provide a new and improved sectional table.

Another object of this invention is to provide a new and improved sectional table which is easily assembled into a multi-sided table.

Another object of this invention is to provide a new and improved table having a plurality of substantially identical sections which, when assembled, may be formed into a table assembly having a central opening for surrounding a columnar object.

Another object of this invention is to provide a new and improved table having a plurality of substantially identical trapezoidal sections which, when assembled, may be formed into a regular polygon having a central opening of the same polygonal shape adapted to surround a columnar object.

Still another object of this invention is to provide a new and improved table having a plurality of substantially identical trapezoidal sections which, when assembled, may be formed into an octagon having a central octagonal opening adapted to surround a columnar object.

Still another object of this invention is to provide a new and improved sectional table which is easily assembled into a multi-sided table with bench seats supported on legs spaced horizontally from the table top to permit a person to sit facing the table.

Still another object of this invention is to provide a new and improved table having a plurality of substantially identical trapezoidal sections which, when assembled, may be formed into a regular polygon having a central opening of the same polygonal shape adapted to surround the trunk of a tree or a shaft or post when assembled and secured side-to-side with the major sides positioned to the outside of the assembly.

Still another object of this invention is to provide a new and improved sectional table having a plurality of substantially identical trapezoidal sections which, when assembled, may be formed into a regular polygon having a central opening of the same polygonal shape and of a size sufficient to permit a service person to stand therein to serve the table when assembled and secured side-to-side with the major sides positioned to the outside and one section omitted for access to said central polygonal opening.

Yet another object of this invention is to provide a new and improved sectional table which is easily assembled into a multi-sided table in which the sections may be assembled and secured side-to-side in alternating relation to produce a table assembly of linear form or may be formed into a regular polygon having a central opening of the same polygonal shape adapted to surround the trunk of a tree or a shaft or post when assembled and secured side-to-side with the major sides positioned to the outside of the assembly.

Yet another object of this invention is to provide a new and improved sectional table having a plurality of substantially identical trapezoidal sections which are assembled and secured side-to-side to form two half polygons and rectangular shaped tables are provided and assembled and secured side-to-side thereon to produce a table assembly of elongated shape with an elongated central opening.

Another object of this invention is to provide a new and improved table having a plurality of substantially identical sections which, when assembled, may be formed into a regular polygon having a central opening of the same polygonal shape adapted to surround a columnar object, each of the sections having a table top assembly comprising a wooden frame of regular trapezoidal shape with a wood top, a plurality of vertically extending wooden legs depending from and secured on the table top frame, and wooden bench seats supported on the legs, and secured together in side-to-side relation in a desired configuration.

Other objects of this invention will become apparent from time to time throughout the specification and claims as hereinafter related.

The foregoing objects and other objects of this invention are accomplished by a sectional table for outdoor use comprising a plurality of substantially identical sections which, when assembled, may be formed into a regular polygon, e.g. octagon, etc., having a central opening of the same polygonal shape adapted to surround a columnar object, such as a tree, shaft or post, or which may have one section omitted to leave open a central opening accessible for service to the table. The table is formed of wood boards of the desired size and shape. Each of the sections comprises a table top of regular trapezoidal shape having a major side of the size of one side of the outer regular polygon and a minor side parallel to the major side and two angular sides. The minor side is of the size of one side of the central polygonal opening. A plurality of vertically extending legs depend from and support the table top. Bench seats are supported on the legs spaced horizontally from the table top major side far enough for a person to sit thereon facing the table top. Bolts, screws or other supporting members secure a plurality of the table sections together in side-to-side relation in a selected configuration. The sections may secured together with the minor sides facing inward to form the desired polygon, with one section omitted to leave a service opening, or with the minor and major sides alternation to produce a linear table assembly. Rectangular table sections may be introduced into the structure to elongate or enlarge the central opening.

DESCRIPTION OF THE PREFERRED EMBODIMENTS

Figure 1:
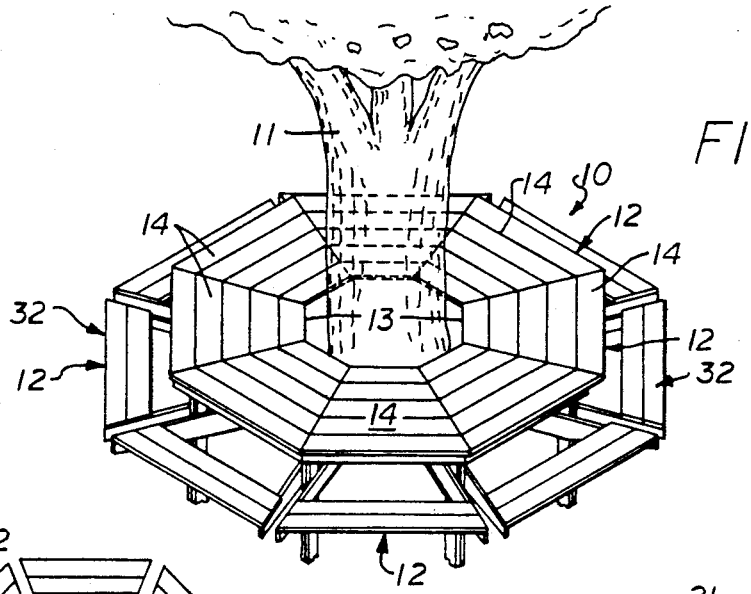
FIG. 1 is an isometric view of a sectional table assembled surrounding a tree and illustrating a preferred embodiment of this invention.

Referring to the drawings by numerals of reference, and more particularly to FIG. 1, there is shown a sectional table assembly 10 for outdoor use comprising a plurality of sections assembled together around a columnar object 11, such as a tree, a shaft or a post. Table assembly 10 comprises a plurality of substantially identical sections 12 (FIGS. 1–3) which, when assembled, may be formed into a regular polygon having a central opening 13 of the same polygonal shape adapted to surround columnar object 11.

Each section 12 (FIGS. 4–5) comprises a table top 14 of regular trapezoidal shape having a major side 15 of the size of one side of the regular polygon and a minor side 16 parallel to the major side and two angular sides 17 and 18. The minor side 16 is the size of one side of central polygonal opening 13. The preferred embodiment shown is octagonal in shape although other polygonal shapes, pentagon, hexagon, etc. may be used.

Figure 4:
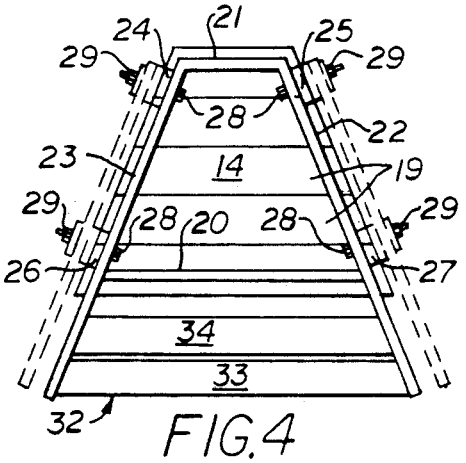
FIG. 4 is a bottom plan view of one table top section of the table shown in FIG. 1.
Figure 5:
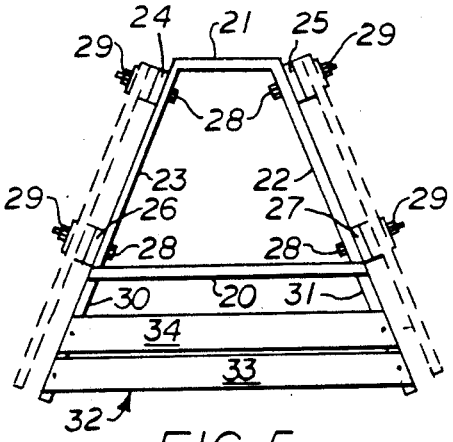
FIG. 5 is a top view of one table top section of the table shown in FIG. 1 with the top removed to show the framing.
Figure 6:
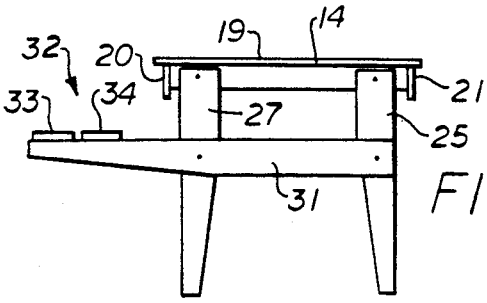
FIG. 6 is a side elevation of one table top section of the table shown in FIG. 1.

Each table top 14 comprises a plurality of separate boards 19 of progressively smaller size and cut to provide said angular sides 17 and 18 on assembly. Boards 19 are secured by nails or screws to a frame comprising a long outer frame board 20, small inner frame board 21, and side frame boards 22 and 23. The framing comprising boards 20, 21, 22 and 23 is preassembled as a trapezoidal shape with fitted corners (FIGS. 4 and 5) with top boards 19 secured thereon with a front, back and side overhang (FIG. 4). While the preferred embodiment utilizes separate boards 19 in the top assembly, a solid top of cabinet grade plywood, Formica laminate, etc., may be used if desired. In the embodiment shown, the top boards 19 are alternating 1"×6" and 1"×8" finished, weather-treated boards, and the frame boards 20–23 are 2"×4" boards.

Four vertically extending legs 24, 25, 26, and 27 depend from and support the table top 14. Legs 24 and 26 are secured on the outside of frame board 23. Legs 25 and 27 are secured on the outside of frame board 22. The legs 24–27 are secured in place by a set of bolts 28 and nuts 29 for each connection. A pair of boards (outriggers) 30 and 31 are secured horizontally on opposing pairs of legs 25 and 27, and 24 and 26, respectively.

Bench seats 32 are supported on outriggers 30 and 31 spaced horizontally from the table top major side 15 a distance sufficient for a person to sit facing the table top. Bench seats 32 comprise a pair of boards 33 and 34. In the embodiment shown, the legs 24–27 are 2"×6" at the top and taper to 2"×3" at the bottom. Outriggers 30, 31 are 2"×6" and taper to 2"×2" at their outer ends. Seat boards are 2"×4".

In the embodiment shown, the assembled table sections 12 are each trapezoidal in shape and sized to fit together to form an octagonal table assembly 10 (FIG. 1). Each table section 12, including the bench seats 32 forms a truncated octant. The table tops 14 overhang the framing on each side by the thickness of the legs 24–27 so that the tops abut each other when assembled together. The edges of the bench seats 32 terminate at the outer edges of the outriggers 30, 31 with the seats of adjacent table sections spaced apart by the thickness of two of the legs 24–27. All connections are made through holes in the various boards by bolts 28 and nuts 29.

ASSEMBLY AND USE

In assembling an octagonal embodiment of the invention, as in FIG. 1, first select one of the preassembled tops 14 and place it on a protected surface topside down and framing up. Install bolts 28 through holes in frame boards 22 and 23 with the threaded ends facing outward. On each of the projecting bolts, place two of the legs 24–27, a total of eight legs on the initial assembly. The outer legs on each bolt will be legs for one side of the next adjacent table section. The partially assembled table section is then inverted to stand on its legs adjacent to the tree, post or shaft or other columnar object which it is to surround.

The next section is prepared by selecting another one of the preassembled tops 14 and placing it on a protected surface topside down and framing up. Install bolts 28 through holes in frame board 22 with the threaded ends facing outward. On each of the projecting bolts, place two of the legs 24–27, a total of four legs on this assembly. The outer legs on each bolt will be legs for one side of the next adjacent table section. This partially assembled table section is then inverted to stand on two of its legs and the other side of the table assembly is connected to its legs on the initial section by the bolts extending therefrom. The nuts and washers are then placed on the ends of the two assembled sections and tightened to secure them together. This procedure is repeated six more times until the table assembly completely surrounds the columnar object.

Figure 3:
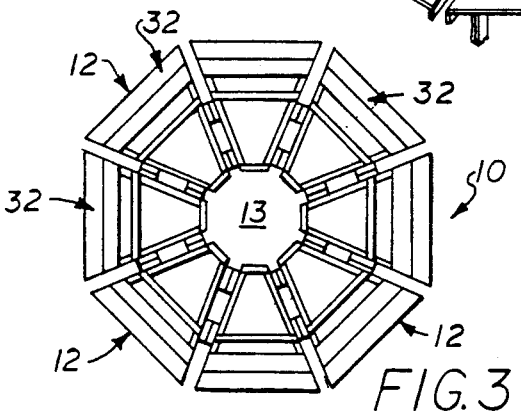
FIG. 3 is a bottom plan view of the table shown in FIG. 1.
Figure 2:
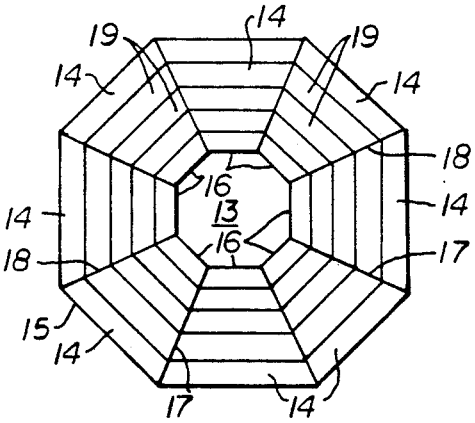
FIG. 2 is a top plan view of the table top shown in FIG. 1.

Next, the outriggers 30, 31 are installed on the legs 24–27 of each of the table sections. The bench seat boards 33, 34 are then installed on the outer ends of the outriggers with the longer boards at the outside as seen in FIGS. 1–3. The finished assembly is as seen in FIG. 1.

Figure 7:
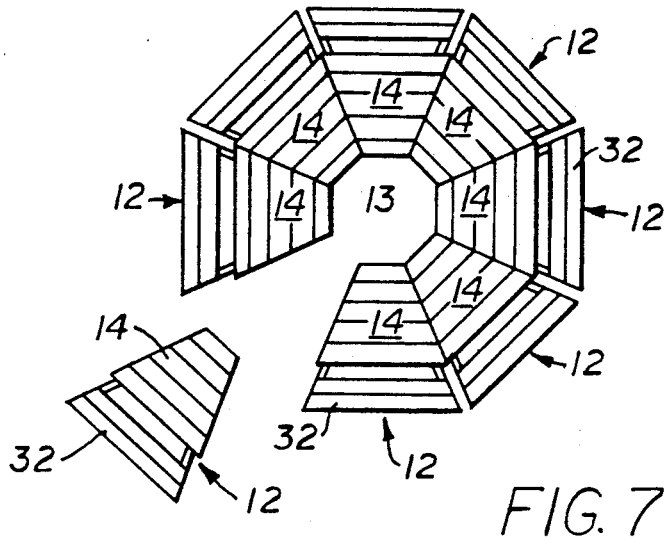
FIG. 7 is a top plan view of a table assembly as shown in FIG. 1 with one section removed to permit entrance for service to the table.
Figure 8:
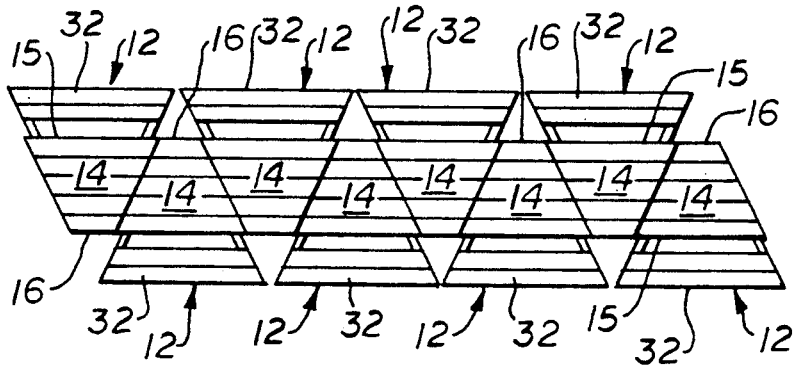
FIG. 8 is a top plan view of the table top sections shown in FIG. 2 assembled in an alternating arrangement as a linear table assembly.
Figure 9:
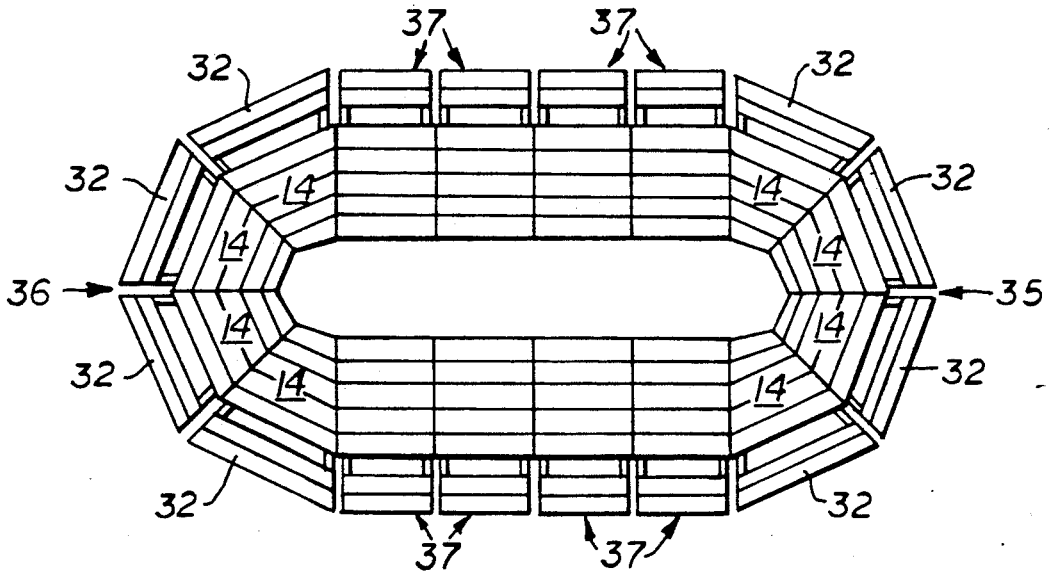
FIG. 9 is a top plan view of the table top sections shown in FIG. 2 assembled in two half octagons connected by rectangular filler tables producing an elongated table assembly with an elongated central opening.

The individual table sections 12 can be assembled separately for use with less than a completely formed polygonal table, if desired. In most applications, however, the sections will be assembled as a complete polygon surrounding a tree, post or shaft. The size of the sections and the size of the central polygonal opening 13 will be selected to fit the object to be surrounded by the assembled table 10. The table can surround a rather large tree trunk or can surround a smaller post or shaft, such as an umbrella post or stand. If desired, in table assemblies with a large central opening 13, one of the table sections can be omitted (FIG. 7) to provide an entrance for a person to enter and serve the persons seated at the table. Also, the individual sections may be assembled with the major sides 15 and minor sides 16 alternating (FIG. 8) to produce a linear table assembly. The table sections 12 can be assembled to form half polygons 35, 36 (FIG. 9) connected by rectangular table sections 37 to produce an elongated table with an elongated center opening 38. Rectangular table sections 37 are constructed in the same manner as table sections 12 except that they are rectangular in plan view.

While this invention has been described fully and completely, with emphasis on a few preferred embodiments, it should be understood that, within the scope of the appended claims, this invention may be practiced otherwise than as specifically described herein.

I claim:

1. A sectional table for outdoor use comprising a plurality of substantially identical sections assembled into a regular polygon having a central opening of the same polygonal shape adapted to surround a columnar object, each of said sections comprising a table top of regular trapezoidal shape having a major side of the size of one side of said regular polygon and a minor side parallel to said major side and two angular sides, said minor side being of the size of one side of said central polygonal opening, a plurality of vertically extending legs depending from and supporting said table top, bench seats supported on said legs spaced horizontally from said table top major side a distance sufficient for a person to sit thereon facing said table top, and means securing said bench seats on said legs and also securing said adjacent legs of adjacent identical sections together in side-to-side relation in a selected configuration.

2. A sectional table according to claim 1 in which said sections are of a size and shape forming an octagon with a central octagonal opening when assembled and secured side-to-side with the major sides positioned to the outside of the assembly, and said table top major side being of the size of one side of said octagon and said minor side being of the size of one side of said central octagonal opening.

3. A sectional table according to claim 1 in which said central polygonal opening is of a size sufficient to surround the trunk of a tree when assembled and secured side-to-side with the major sides positioned to the outside of the assembly.

4. A sectional table according to claim 1 in which said central polygonal opening is of a size sufficient to surround a shaft or post when assembled and secured side-to-side with the major sides positioned to the outside of the assembly.

5. A sectional table according to claim 1 in which said central polygonal opening is of a size sufficient to permit a service person to stand therein to serve the table when assembled and secured side-to-side with the major sides positioned to the outside and one section omitted for access to said central polygonal opening.

6. A sectional table according to claim 1 in which said sections are made of wood and secured together by bolts or screws.

7. A sectional table for outdoor use comprising a plurality of substantially identical sections which, when assembled, may be formed into a regular polygon having a central opening of the same polygonal shape adapted to surround a columnar object, each of said sections having a table top assembly comprising a wooden frame of regular trapezoidal shape with a wood top secured thereon having a major side of the size of one side of said regular polygon and a minor side parallel to said major side, said major side being of the size of one side of said central polygonal opening, a plurality of vertically extending wooden legs depending from and secured on angular side components of said table top trapezoidal frame, supporting boards are secured on said legs extending horizontally outward a predetermined distance at an angle defined by the position of said legs, wooden bench seats supported on said legs spaced horizontally from said table top major side far enough for a person to sit thereon facing said table top, said bench seats comprise a plurality of boards of trapezoidal shape secured on said supporting boards at the outer ends thereof and having end edges terminating at the outside surface of said supporting boards, and means to secure a plurality of said sections together in side-to-side relation in a selected configuration.

8. A sectional table according to claim 7 in which said wooden top comprises a plurality of boards secured on said wooden frame of a size and shape producing said trapezoidal shape.

9. A sectional table according to claim 8 in which said section table tops are of a size and shape forming an octagon with a central octagonal opening when assembled and secured side-to-side with the major sides positioned to the outside of the assembly, and the board of said table top major side being of the size of one side of said octagon and the board of said minor side being of the size of one side of said central octagonal opening.

10. A sectional table according to claim 7 in which supporting boards are secured on the outside of said legs extending horizontally outward a predetermined distance at an angle defined by the position of said legs, and said bench seats comprise a plurality of boards secured on said supporting boards at the outer ends thereof, said section securing means comprising bolts extending through adjacent legs and adjacent supporting boards on two adjacent table sections to secure said sections together and said supporting boards on said legs.

11. A sectional table according to claim 7 in which said section securing means comprising bolts extending through adjacent legs and adjacent supporting boards on two adjacent table sections to secure said sections together and said supporting boards on said legs.

12. A sectional table according to claim 11 in which said sections are assembled and secured side-to-side in alternating relation to produce a table assembly of linear form.

13. A sectional table according to claim 11 in which said sections are assembled and secured side-to-side to form two half polygons and rectangular shaped tables are provided and assembled and secured side-to-side thereon to produce a table assembly of elongated shape with an elongated central opening.

14. A sectional table according to claim 11 in which said central polygonal opening is of a size sufficient to surround the trunk of a tree when assembled and secured side-to-side with the major sides positioned to the outside of the assembly.

15. A sectional table according to claim 11 in which said central polygonal opening is of a size sufficient to surround a shaft or post when assembled and secured side-to-side with the major sides positioned to the outside of the assembly.

16. A sectional table according to claim 11 in which said central polygonal opening is of a size sufficient to permit a service person to stand therein to serve the table when assembled and secured side-to-side with the major sides positioned to the outside and one section omitted for access to said central polygonal opening.

* * * * *